United States Patent [19]

Rodondi et al.

[11] Patent Number: 4,834,670

[45] Date of Patent: May 30, 1989

[54] INSULATION DISPLACEMENT TERMINAL ASSEMBLY

[75] Inventors: Andrew F. Rodondi, Sharpsville, Pa.; Alfonso Vazquez-Cuervo, Warren; Christopher D. Burns, Niles, both of Ohio

[73] Assignee: General Motors Corporation, Detroit, Mich.

[21] Appl. No.: 156,405

[22] Filed: Feb. 16, 1988

[51] Int. Cl.[4] ..... H01R 4/24

[52] U.S. Cl. ..... 439/398; 439/400; 439/399

[58] Field of Search ..... 439/389–413, 439/443, 595, 733, 695, 696, 701, 752, 869

[56] References Cited

U.S. PATENT DOCUMENTS

| | | | |
|---|---|---|---|
| 3,992,072 | 11/1976 | Anhalt et al. | 459/595 |
| 4,045,112 | 8/1977 | Rodondi et al. | 439/595 |
| 4,047,785 | 9/1977 | Jayne | 439/398 |
| 4,405,193 | 9/1983 | Weidler | 439/398 |

*Primary Examiner*—David Pirlot
*Attorney, Agent, or Firm*—F. J. Fodale

[57] ABSTRACT

An insulation displacement terminal assembly comprises an insulation displacement terminal having a U-shaped insulation displacement portion which has two plate sections that are connected by a bight and insulation displacement slots that extend through the bight and down into the plate sections in aligned pairs of insulation piercing slot portions. A plurality of insulated electric cables are disposed in the insulation piercing slot portions and retained therein to form a sub-assembly. The sub-assembly is assembled into a slide-in insulator housing portion which has slots in its opposed side walls through which the insulated electric cables of the sub-assembly extend and a retention tongue that is cantilevered from a back wall of the housing portion and runs parallel to the slotted side walls to project between the insulated electric cables and the bight of the insulation displacement terminal to retain the electric cables down in the insulation displacement slot portions.

11 Claims, 3 Drawing Sheets

INSULATION DISPLACEMENT TERMINAL ASSEMBLY

BACKGROUND OF THE INVENTION

This invention relates generally to terminal assemblies and more specifically to insulation displacement terminal assemblies.

U.S. Pat. No. 3,617,983 granted to George Allen Patton Nov. 2, 1971 discloses an insulation displacement terminal which comprises a section of metal strip bent 180 degrees intermediate its end to form two plate sections connected by a bight. A slot extends through the bight and partially into the plate sections to provide insulation displacement slots which pierce the insulation of an insulated electric cable to establish electrical contact with the conductive core of the cable when the insulated electric cable is pushed down into the slots.

U.S. Pat. No. 3,760,335 granted to Lincoln Edwin Roberts Sept. 18, 1973 discloses an electrical connector having a plurality of electrical contact terminals disposed in a housing. The rearward ends of the terminals have exposed insulation displacement portions of the slotted plate type, which are described in the Patton '983 patent, for attaching the terminals to insulated electric cables. The electrical connector disclosed in the Roberts '335 patent further includes a cover for the housing which functions to ensure that the insulation pierced electric cables are maintained in the insulation piercing slots of the terminals.

U.S. Pat. No. 4,116,522 granted to Charles Edward Reynolds Sept. 26, 1978 discloses an insulation displacement terminal of the slotted plate type in which the slotted plates have closed slots between the insulation piercing slots to increase the resilience of the terminal portions forming the insulation piercing slots.

SUMMARY OF THE INVENTION

The object of this invention is to provide an improved insulation displacement terminal assembly for an insulation displacement terminal of the slotted plate type.

A feature of the invention is that the insulation displacement terminal assembly has a slide-in housing which ensures that the insulation pierced electric cable is maintained in the insulation piercing slots in a very effective manner.

Another feature of the invention is that the insulation displacement terminal assembly has a terminal which has a plurality of parallel insulation displacement slots which facilitates automated assembly and which makes the assembly particularly useful for splicing.

Yet another feature of the invention is that the slide-in housing has a retention tongue which is disposed between the bight of the slotted plate type insulation displacement terminal and the insulation pierced cable to maintain the insulation pierced cable in the insulation displacement slots in a very effective manner.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
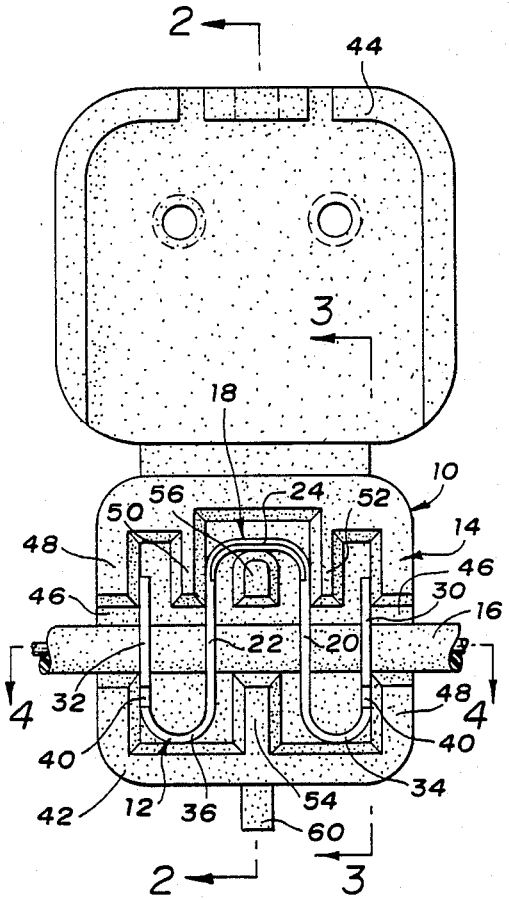
FIG. 1 is front view of an insulation displacement terminal assembly in accordance with our invention with the housing cover open to show the internal relationship between the housing portion and the insulation displacement terminal.
Figure 2:
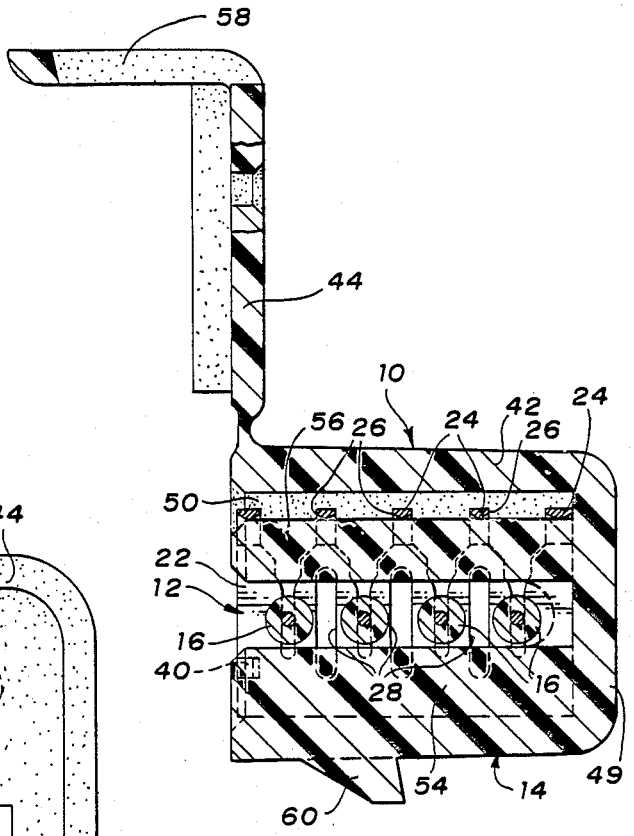
FIG. 2 is a section taken substantially along the line 2—2 of FIG. 1 looking in the direction of the arrows.
Figure 3:
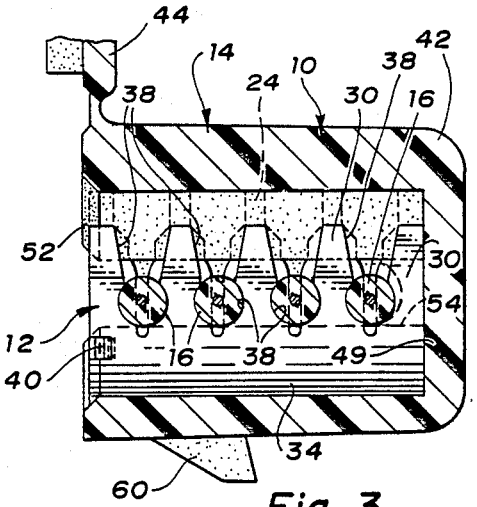
FIG. 3 is a section taken substantially along the line 3—3 of FIG. 1 looking in the direction of the arrows.
Figure 4:
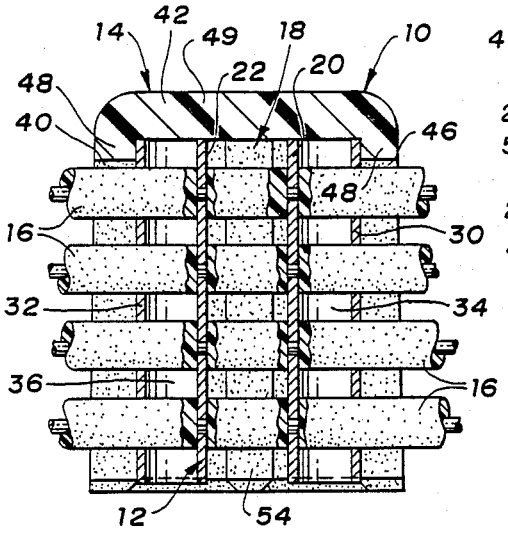
FIG. 4 is a section taken substantially along the line 4—4 of FIG. 1 looking in the direction of the arrows.

Referring to the drawing the insulation displacement terminal assembly 10 comprises an insulation displacement terminal 12 that is disposed in an insulator housing 14 and attached to a plurality of insulated electric cables 16 which pass through the insulator housing 14.

Figure 6:
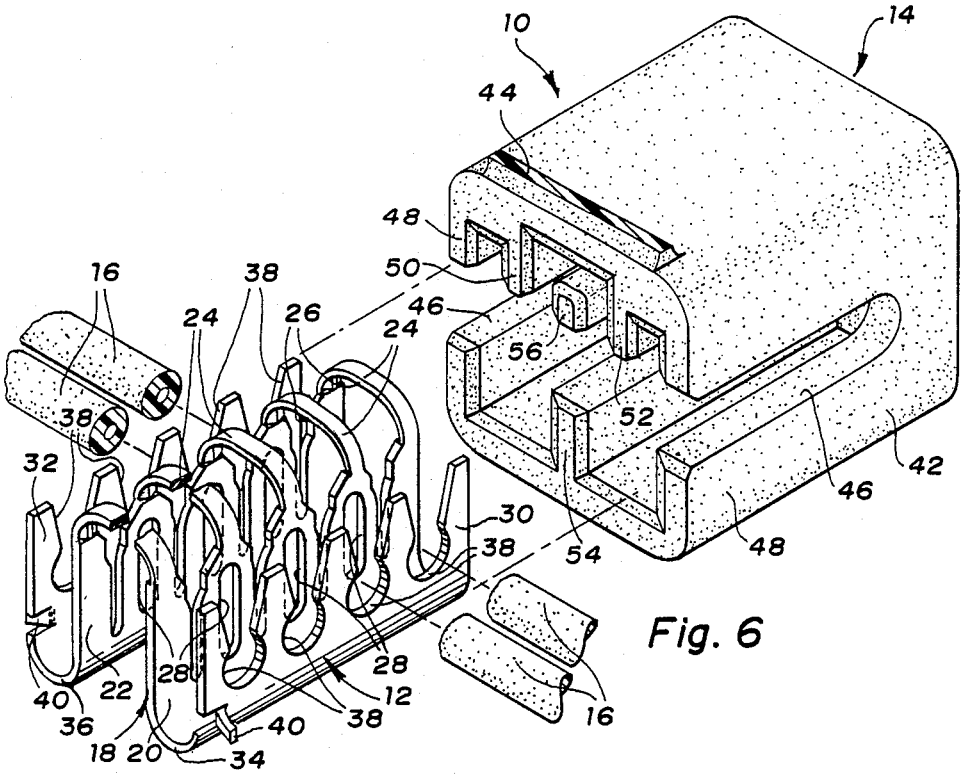
FIG. 6 is an exploded perspective view showing the insulation displacement terminal in the process of being assembled into the insulator housing.

The insulation displacement terminal 12 is made of beryllium copper or other suitable conductive material and comprises a U-shaped insulation displacement portion 18 which has two plate sections 20 and 22 connected by a bight 24. The insulation displacement portion 18 has a plurality of parallel insulation displacement slots 26 which extend through the bight 24 and down into the plate sections 20 and 22 in aligned pairs as best shown in FIG. 6.

The parallel insulation displacement slots 26 are wide at the bight 24 in order to receive the insulated electric cables 16 and guide them into the narrow slot portions in the plate sections 20 and 22 that pierce the insulation and engage the conductive cores of the insulated electric cables 16 in a well known manner.

The plate sections 20 and 22 may also include closed slots 28 between the insulation displacement slots 26 to increase resilience and equalize the bias of the terminal 12 against each side of the electric cables 16 which are pushed down into the insulation displacement slots 26.

The insulation displacement terminal 12 further includes holder plates 30 and 32 which are connected to the respective plate sections 20 and 22 by bights 34 and 36. The holder plates have open ended retention slots 38 aligned with the respective insulation displacement slots 26. These retention slots 38 have wide tapered mouth portions which receive the insulated electric cables 16 and guide them into retention portions at the lower ends of the retention slots 38. The retention slots 38 are not designed to pierce the insulation of the electric cables 16 but to retain and position the electric cables 16 down in the insulation displacement slots 26 for slide-in assembly into the housing 14.

The insulation displacement terminal 12 also includes two retention tabs 40 that project outwardly of the respective holder plates 30 and 32 and cooperate with the housing 14 to retain the terminal 12 in the housing 14.

The insulator housing 14 itself comprises a housing portion 42 and an integrally hinged cover portion 44 that is shown in the open position in FIGS. 1, 2, 3, 4 and 6. The housing portion 42 has slots 46 in its opposed side walls 48. The slots 46 extend from the open end of the housing portion 42 toward the back wall 49.

The housing portion 14 has three internal stabilizer ribs 50, 52 and 54 and a retention tongue 56 that run parallel to the slotted side walls 48. The stabilizer ribs 50 and 52 depend from the upper wall of the housing portion 42 and are spaced to slidable receive the insulation displacement portion of the terminal 12 between them as best shown in FIG. 1. The stabilizer ribs 50 and 52 thus stabilize the terminal 12 in the lateral direction between the slotted side walls 48.

The stabilizer rib 54 projects from the middle of the lower wall to support the insulated electric cables 16 between the plate portions 20 and 22.

The retention tongue 56 is cantilevered from the back wall 49 so that it is disposed between the insulated electric cables 16 and the bight 24 of the insulation displacement terminal 14. Thus the retention tongue 56 maintains the insulated electric cables 16 in the insulation displacement slots 26 in a very effective manner.

Figure 5:
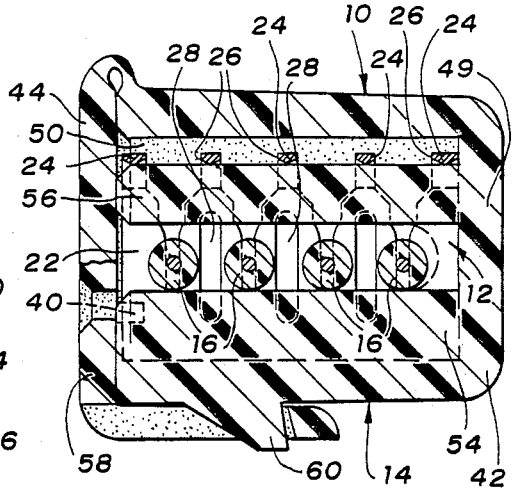
FIG. 5 is a view similar to FIG. 2 but showing the cover in the closed position.

The cover portion 44 includes a latch arm 58 that engages a lock projection 60 of the housing portion to retain the cover portion 44 in the closed position as shown in FIG. 5.

The insulation displacement terminal assembly is assembled by pushing the insulated electric cables 16 down into the narrow portions of the insulation displacement slots 24 in the plates 20 and 22 to establish electrical contact between the conductive cores of the electric cables 16 and the insulation displacement terminal 12. The electric cables are retained in position by the retention slots 38 of the holder plates 30 and 32 so that the sub-assembly comprising the electric cables 16 and insulation displacement terminal 12 slides easily into the housing portion 42 of the insulator housing 14 assisted by the stabilizer ribs 50, 52 and 54 which properly position the sub-assembly.

As the sub-assembly slides into the housing portion 42, the retention tongue 56 that is cantilevered from the back wall 49 slides between the insulated electric cables 16 and the bight 24 of the insulation displacement terminal 14 to retain the insulation pierced cables 16 down in the insulation displacement slots 24 in a very effective manner. The inner surface of the bight 24 is convex in transverse section as shown in FIGS. 1, 2, 5 and 6 to assist the slide-in action of the retention tongue 56. Upon complete slide-in, the sub-assembly is retained in the housing portion 42 by the retention tabs 40 of the terminal 12 which dig into the side walls 48 of the housing portion 42 until the cover 44 is closed as shown in FIG. 5.

Figure 7:
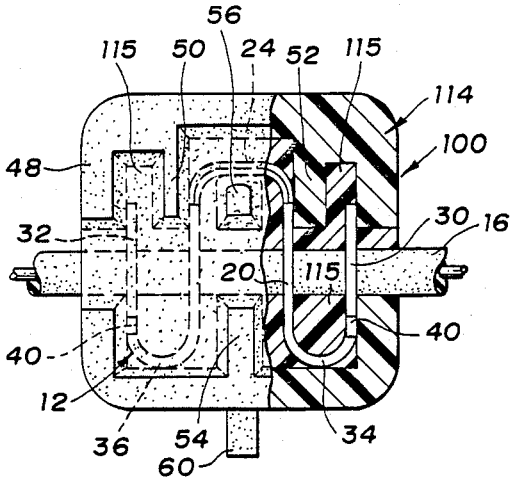
FIG. 7 is a front view of an alternate embodiment of our invention.

Referring now to FIG. 7, an alternate embodiment is illustrated. The insulation displacement terminal assembly 100 is characterized by a coverless housing 114 which is filled with a sealant 115 after the sub-assembly comprising the insulation displacement terminal 12 and insulation pierced electric cables 16 is slid into the coverless housing 114. In this regard it should be noted that the holder plates 30 and 32 also serve to seal the housing slots 146 against any substantial leakage of sealant during the filling process.

Figure 8:
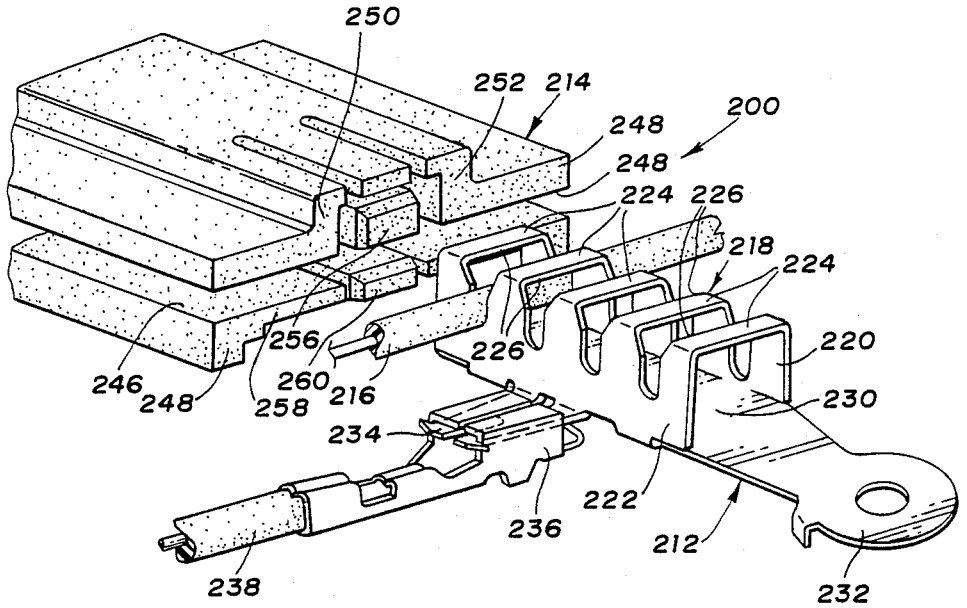
FIG. 8 is an exploded perspective view of another alternate embodiment of our invention.

Referring now to FIG. 8, another alternate embodiment is illustrated. The insulation displacement terminal assembly 200 is characterized by a modified insulation displacement terminal 212. The terminal 212 also has a U-shaped insulation displacement portion 218 which has two plate sections 220 and 222 connected by a bight 224 and plurality of parallel insulation displacement slots 226 which extend through the bight 224 and down into the plate sections 220 and 222. However the modified terminal includes a base 230 which is integrally attached to the bottom of plate section 220 and secured to the bottom of plate section 222. The base 230 has a longitudinal extension which forms a ring terminal 232 and a bifurcated lateral extension which forms a tab terminal 234. The slide-in housing 214 is still coverless but it is further modified to accommodate a female terminal 236 on the end of an electric cable 238 which is mated to the tab terminal 234.

The slots 246 are in opposed side walls 248 of the slide-in housing 214 which are stepped inwardly at the upper end to provide integrated stabilizer ribs 250 and 252 which position the terminal 212 laterally in the housing 214. The housing 214 also still includes a cantilevered retention tongue 256 which slides between the insulation pierced electric cables 216 and the bight 224. However, the bottom wall 258 of the housing 214 is raised and slotted to provide a second retention tongue 260 which slides between the insulation pierced electric cables 216 and the base 230 of the terminal 212. The female terminal 236 is accommodated beneath the raised bottom wall 258 when the terminal 212 is slid into the housing 214.

We wish it to be understood that we do not desire to be limited to the exact details of construction shown and described, for further obvious modifications will occur to a person skilled in the art.

The embodiments of the invention in which an exclusive property or privilege is claimed are defined as follows:

1. An insulation displacement terminal assembly comprising;

an insulation displacement terminal having a U-shaped displacement portion which has two plate sections that are connected by a bight and at least one insulation displacement slot that extends through the bight and down into the plate sections in an aligned pair of insulation piercing slot portions, an insulated electric cable disposed in the insulation piercing slot portions of the insulation displacement slot and retained therein to form a sub-assembly, and an insulator housing having a housing portion which receives the sub-assembly, the housing portion having a slot in its side wall through which the insulted electric cable of the sub-assembly extends and a retention tongue that is cantilevered from a back wall of the housing portion and runs parallel to the slotted side wall to project between the two plate sections and between the insulated electric cable and the bight of the insulation displacement terminal whereby the electric cable is held in an insulation pierced portion down in the insulation displacement slot of the insulation displacement terminal.

2. The insulation displacement terminal assembly as defined in claim 1 wherein the insulation displacement portion has a plurality of parallel insulation displacement slots which extend through the bight and down into the plate sections in aligned pairs.

3. The insulation displacement terminal assembly as defined in claim 1 wherein the insulation displacement terminal has holder plates disposed outboard of and connected to the plate sections by bights, the holder plates having open ended retention slots which are aligned with the insulation displacement slots of the terminal.

4. The insulation displacement terminal assembly as defined in claim 3 wherein the housing has an integrally hinged cover portion which is latched in a closed position after the sub-assembly is slid into the housing portion.

5. The insulation displacement terminal assembly as defined in claim 3 wherein the housing is filled with a sealant after the sub-assembly is slid into the housing portion.

6. The insulation displacement terminal assembly as defined in claim 1 wherein the insulation displacement terminal has a base which is attached to one of the plate sections and which has an extension which forms a terminal for mating to a complementary terminal.

7. The insulation displacement terminal assembly as defined in claim 6 wherein the housing portion has a second retention tongue which is disposed between the insulated electric cable and the base of the terminal.

8. An insulation displacement terminal assembly comprising;

an insulation displacement terminal having a U-shaped insulation displacement portion which has two plate sections connected by a bight and a plurality of parallel insulation displacement slots which extend through the bight and down into the plate sections in aligned pairs, the parallel insulation displacement slots being wide at the bight in order to receive insulated electric cables and guide them into narrow slot portions in the plate sections that pierce the insulation and engage conductive cores of the insulated electric cables, the insulation displacement terminal further including holder plates which are disposed outboard of and connected to the respective plate sections by bights, the holder plates having open ended retention slots aligned with the respective insulation displacement slots, the retention slots having wide tapered mouth portions which receive the insulated electric cables and guide them into retention portions at the lower ends of the retention slots, a plurality of insulated electric cables disposed in the respective insulation displacement slots and retained therein by the retention slots to form a sub-assembly, and an insulator housing having a housing portion which receives the sub-assembly, the housing portion having slots in opposed side walls through which the insulated electric cables of the sub-assembly extend and a plurality of stabilizer ribs and a retention tongue that run parallel to the slotted side walls, the stabilizer ribs including a pair of stabilizer ribs which depend from an upper wall of the housing portion to engage and stabilize the terminal in the lateral direction between the slotted side walls and a stabilizer rib which projects from a lower wall so that it supports the insulated electric cables between the plate portions of the terminal, the retention tongue being cantilevered from a back wall so that it is disposed between the insulated electric cables and the bight of the insulation displacement terminal.

9. The insulation displacement terminal assembly as defined in claim 8 wherein the insulator housing has an integrally hinged cover portion which includes a latch arm that engages a lock projection of the housing portion to retain the cover portion in the closed position.

10. The insulation displacement terminal assembly as defined in claim 8 wherein the insulator housing has a coverless housing portion which is filled with a sealant after the sub-assembly is slid into the housing portion.

11. An insulation displacement terminal assembly comprising an insulation displacement terminal having a U-shaped insulation displacement portion which has two plate sections that are connected by a bight and at least one insulation displacement slot that extends through the bight and down into the plate sections in an aligned pair of insulation piercing slot portions, an insulated electric cable disposed in the insulation piercing slot portions of the insulation displacement slot and retained therein to form a sub-assembly, and and insulator housing having a housing portion which receives the sub-assembly, the housing portion having a retention tongue that is secured to the housing portion and is disposed inside the U-shaped insulation displacement portion between the insulated electric cable and the bight of the insulation displacement portion to hold the electric cable in an insulation pierced portion down in the insulation displacement slot of the insulation displacement terminal.

* * * * *